US011412861B1

(12) United States Patent
Antinori et al.

(10) Patent No.: US 11,412,861 B1
(45) Date of Patent: Aug. 16, 2022

(54) MATTRESS COMPRISING A CORE OF POCKET SPRINGS DISPOSED WITHIN A PERIPHERY OF OUTER SPRINGS

(71) Applicants: Steven J. Antinori, Tampa, FL (US); Jayme Antinori, Tampa, FL (US)

(72) Inventors: Steven J. Antinori, Tampa, FL (US); Jayme Antinori, Tampa, FL (US)

(73) Assignee: Protscel, LLC, Tampa, FL (US)

( * ) Notice: Subject to any disclaimer, the term of this patent is extended or adjusted under 35 U.S.C. 154(b) by 143 days.

(21) Appl. No.: 16/873,030

(22) Filed: Jan. 20, 2020

Related U.S. Application Data

(60) Provisional application No. 62/918,825, filed on Feb. 13, 2019.

(51) Int. Cl.
*A47C 27/06* (2006.01)

(52) U.S. Cl.
CPC ..... *A47C 27/064* (2013.01); *A47C 27/062* (2013.01)

(58) Field of Classification Search
CPC ... A47C 27/064; A47C 27/062; A47C 27/066; A47C 27/06; A47C 27/061; A47C 23/007; A47C 23/0433
See application file for complete search history.

(56) References Cited

U.S. PATENT DOCUMENTS

| | | | | |
|---|---|---|---|---|
| 8,978,183 | B1 * | 3/2015 | Richmond | A47C 27/064 5/655.8 |
| 10,104,970 | B1 * | 10/2018 | Stiles | A47C 7/34 |
| 10,206,515 | B1 * | 2/2019 | Jewett | A47C 27/062 |
| 2002/0195756 | A1 * | 12/2002 | Wells | A47C 23/04 267/93 |
| 2005/0257323 | A1 * | 11/2005 | Edling | B68G 9/00 5/720 |
| 2012/0102658 | A1 * | 5/2012 | Mantzis | A47C 27/062 5/720 |
| 2016/0029809 | A1 * | 2/2016 | Shive | A47C 27/05 5/718 |
| 2020/0229609 | A1 * | 7/2020 | Warner | A47C 27/066 |
| 2020/0307990 | A1 * | 10/2020 | Spinks | B68G 9/00 |

* cited by examiner

*Primary Examiner* — Peter M. Cuomo
*Assistant Examiner* — Alison N Labarge
(74) *Attorney, Agent, or Firm* — Arthur W. Fisher

(57) ABSTRACT

A mattress comprising an interior core of inner pocket springs arranged in a plurality of columns extending between opposite ends of the mattress disposed within an exterior periphery of outer pocket springs arranged in a plurality of columns extending between opposite ends of the mattress and a plurality of rows extending between opposite sides of the mattress where each inner pocket spring and each outer pocket spring has substantially the same in pocket height and out of pocket height, and the outer pocket springs are firmer than the inner pocket springs to create a relatively firm border around the periphery of the mattress.

4 Claims, 7 Drawing Sheets

MATTRESS COMPRISING A CORE OF POCKET SPRINGS DISPOSED WITHIN A PERIPHERY OF OUTER SPRINGS

CROSS REFERENCE

This is a nonprovisional utility application of provisional application Ser. No. 62/918,825, filed Feb. 13, 2019.

BACKGROUND OF THE INVENTION

Field of the Invention

A mattress comprising a core of inner pocket springs disposed within an exterior periphery of outer pocket springs having a greater firmness than the core of inner pocket springs.

Description of the Prior Art

Over time, pocket springs have been developed to form the core of a mattress. Generally, a core of pocket springs is surrounded by a foam border or other suitable material to create a relatively firm periphery about the periphery of the core of pocket springs. More recent mattresses may include a periphery of springs firmer than the core.

US 2018/0049559 discloses a pocketed spring assembly comprises a plurality of parallel strings of springs, each string joined to at least one adjacent string. Each string comprises first and second opposed plies of fabric and a plurality of pockets formed along a length of the string by transverse seams joining the first and second plies. Exterior strings have identical springs in their pockets. Interior strings have two different springs along their length, the outermost springs being firmer than the interior core springs. The pocketed spring assembly has increased firmness or edge support along all four sides due to the different coil springs of the assembly.

US 2015/0359349 shows a pocketed spring assembly similar to that disclosed in US 2018/0049559, In addition, an upper end of each transverse seam is below the upper surface of the string so as to partially separate adjacent pockets within a string of springs. Each spring has two end portions and a middle portion. The convolutions of the middle portion are greater in diameter and pitch than the convolutions of the end portions.

US 2016/0166076 relates to a bedding or seating product comprising a pocketed spring assembly including a plurality of parallel interior strings of individually pocketed coil springs. The interior strings of springs may extend from head-to-foot or side-to-side of the product. The pocketed spring assembly further comprises at least one perimeter string of springs. Each of the springs of each perimeter string of springs has rectangular convolutions to provide edge support to the product.

US 2004/0103479 depicts a bedding or seating product comprising a spring assembly including a plurality of parallel strings of springs joined to each other. Each of the strings of springs comprises a row of interconnected pocketed coil springs. Selected pockets of fabric are shorter than adjacent pockets, so coil springs in the selected pockets are under a greater load than adjacent coil springs. In one preferred embodiment, every other pocket is under a greater load than the adjacent pockets, resulting in a checkerboard arrangement in at least one area of the product.

U.S. Pat. No. 6,295,676 relates to a mattress having a main sleep area surrounded by a perimeter trim. Both the main sleep area and the perimeter trim are formed from wire springs contained within pockets of soft material. The wire springs in the sleep area are arranged in honeycomb nested rows. The wire springs of the perimeter trim, which are of different wire construction with different flex characteristic from the wire springs in the main sleep area, are arranged in side by side rows which are not honeycomb nested. In addition, the wire springs of the perimeter trim are pivotally linked directly to one another across the perimeter trim, both widthwise and lengthwise of the mattress which produces an essentially non-feelable flex transition between the perimeter trim and the main sleep area of the mattress.

U.S. Pat. No. 6,772,706 discloses a pocketed coil spring assembly for use in the manufacture of mattresses or cushions comprising a plurality of strips of integrally connected closed fabric pockets each containing one helically coiled wire compression spring having its axis disposed transversely of the strip, and wherein each of the strips contains a single band of interconnected springs formed from a single length of wire into a plurality of interconnected helical coil springs. The springs of the bands may contain inserts such as foam cylinders or pocketed coil springs to impart differing degrees of firmness to different strips. Adjacent coil springs may be separated by multiple transverse lines of attachment in order to posturize the product.

While some of the prior art may contain some similarities relating to the present invention, none of them teach, suggested or include all of the advantages and unique features of the invention disclosed hereafter.

SUMMARY OF THE INVENTION

The present invention relates to a mattress foundation comprising an interior core of pocket springs disposed within an exterior periphery of pocket springs.

The interior core of pocket springs comprises a plurality of substantially parallel interior columns of inner pocket springs; while the exterior periphery of pocket springs comprises a plurality of substantially parallel peripheral columns of outer pocket springs and substantially parallel to the interior columns of inner pocket springs and a plurality of substantially parallel peripheral rows of outer pocket springs and substantially perpendicular to the substantially parallel interior columns of inner pocket springs and substantially perpendicular to the parallel peripheral columns of outer pocket springs.

The configuration or pattern of the pocket springs comprises springs of different firmness to create a peripheral border of greater support on at least one end portion or side portion of the mattress foundation.

The configuration of patterns may vary to provide different firmness on peripheral border.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
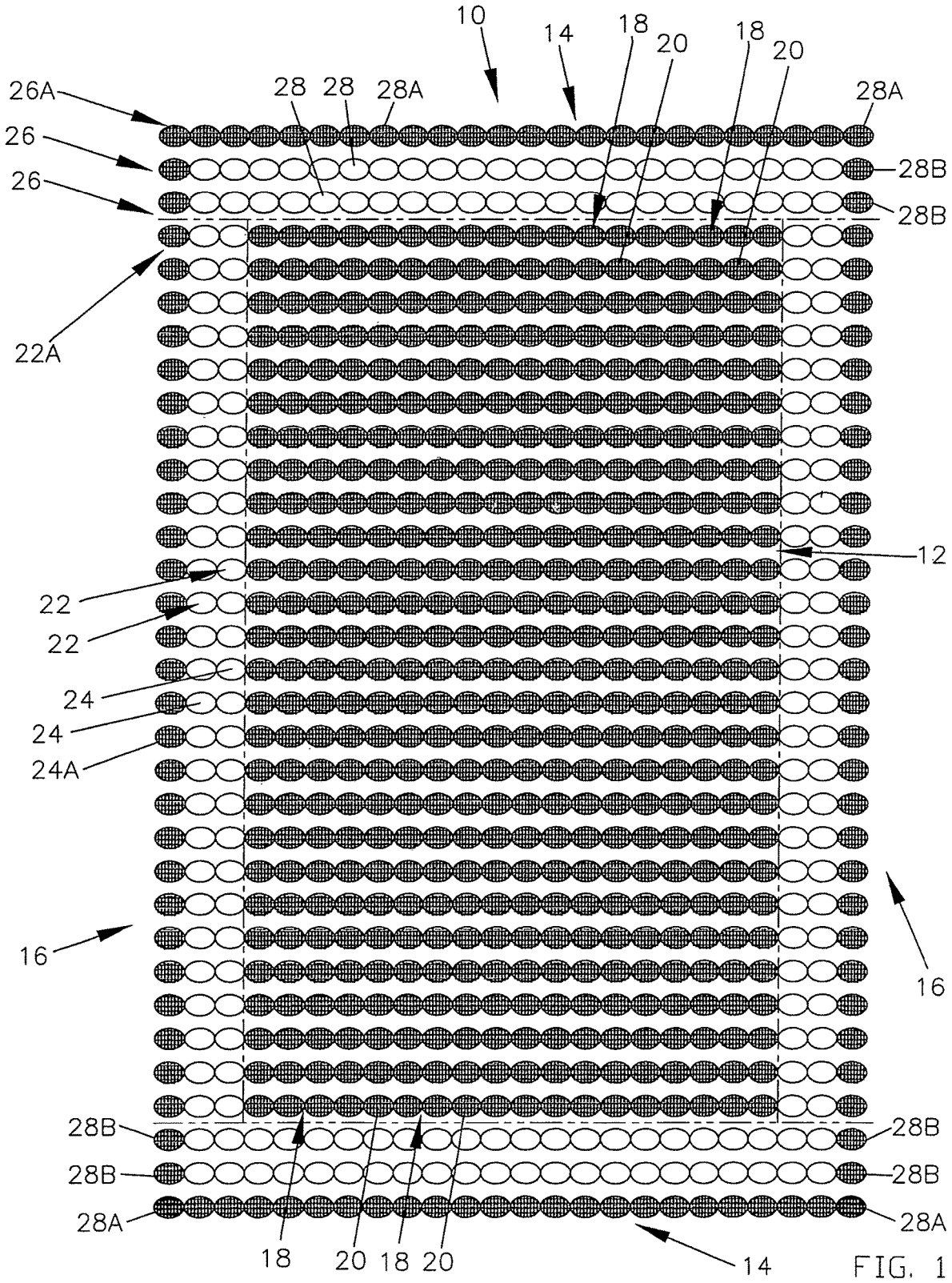
FIG. 1 is a top diagrammatic view of the mattress foundation of the present invention.

As shown in FIG. 1, the present invention relates to a mattress or mattress foundation generally indicated as 10 including end portions each generally indicated as 14 and side portions each generally indicated as 16 comprising an interior core of pocket springs generally indicated as 12 disposed within an exterior periphery of pocket springs.

The interior core 12 of pocket springs comprises a plurality of substantially parallel interior columns each generally indicated as 18 of inner pocket springs 20 extending between end portions 14 of the mattress foundation 10.

The exterior periphery of pocket springs comprises a plurality of substantially parallel peripheral columns each generally indicated as 22 of outer pocket springs 24 extending between end portions 14 of the mattress foundation 10 and substantially parallel to the interior columns 18 of inner pocket springs 20 and a plurality of substantially parallel peripheral rows generally indicated as 26 of outer pocket springs 28 extending between side portions 16 of the mattress foundation 10 and substantially perpendicular to the substantially parallel interior columns 18 of inner pocket springs 20 and substantially perpendicular to the parallel peripheral columns 22 of outer pocket springs 24.

The configuration or pattern of the pocket springs 20, 24, 24A, 28, 28A and 28B comprises springs of different firmness to provide or create a peripheral border of greater support on at least one end portion 14 or side portion 16 of the mattress foundation 10.

For example, each inner pocket spring 20 of the interior core 12 has a first firmness value. Each outer pocket spring 24 of the two inner most peripheral columns 22 and each outer pocket spring 28 of the two inner most peripheral rows 26 has a second firmness value greater than the first firmness value of the inner pocket springs 20.

In addition, each outer pocket spring 24A of the outer most peripheral column 22A and each outer pocket spring 28A in the outer most row 26A together with the outer most pocket springs 28B of the two most inner row 26 of outer pocket springs 28 has a firmness value less than the firmness value of the outer pocket springs 24 in the inner most peripheral columns 22 and the outer pocket springs 28 of the inner most peripheral rows 26.

In other words, pocket springs 20, 24A, 28A and 28B may be constructed of about 15-gauge wire; while, pocket springs 24 and 28 may be constructed of about 13.5-gauge wire.

The out of pocket height of the springs of pocket springs 20, 24, 24A, 28, 28A and 28B is substantially equal. Similarly, the in-pocket height of each pocket spring 20, 24, 24A, 28, 28A and 28B is substantially equal.

Figure 2:
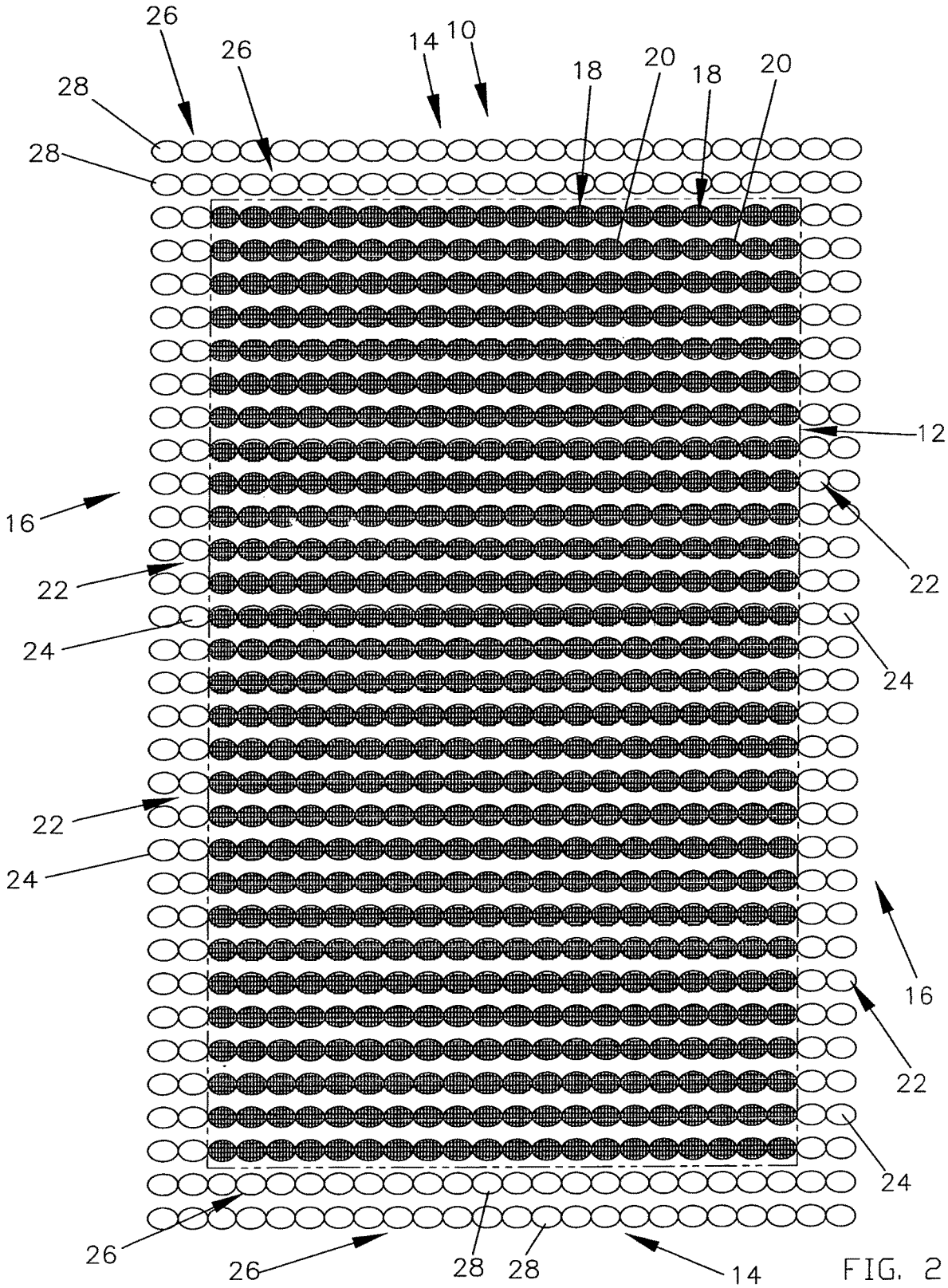
FIG. 2 is a top diagrammatic view of an alternate embodiment of the mattress foundation of the present invention shown in FIG. 1.

FIG. 2 is an alternate embodiment of the mattress foundation 10 shown in FIG. 1 without outer most peripheral column 22A of the outer pocket springs 24A on each side 16 of the mattress foundation 10 and the outer most peripheral row 26A of outer most springs 28A on each end 14 of the mattress foundation 10.

In particular, the mattress foundation 10 including end portions 14 and side portions 16 comprises an interior core of pocket springs 12.

The interior core 12 of pocket springs comprises a plurality of substantially parallel interior columns each generally indicated as 18 of inner pocket springs 20 extending between end portions 14 of the mattress foundation 10.

The exterior periphery of pocket springs comprises a plurality of substantially parallel peripheral columns each generally indicated as 22 of outer pocket springs 24 extending between end portions 14 of the mattress foundation 10 and substantially parallel to the interior columns 18 of inner pocket springs 20 and a plurality of substantially parallel peripheral rows generally indicated as 26 of outer pocket springs 28 extending between side portions 16 of the mattress foundation 10 and substantially perpendicular to the substantially parallel interior columns 18 of inner pocket springs 20 and substantially perpendicular to the parallel peripheral columns 22 of outer pocket springs 24.

The configuration or pattern of the pocket springs 20, 24, and 28 comprises springs of different firmness to provide or create a peripheral border of greater support on at least one end portion 14 or side portion 16 of the mattress foundation 10.

For example, each inner pocket spring 20 of the interior core 12 has a first firmness value. Each outer pocket spring 24 of the two peripheral columns 22 and each outer pocket spring 28 of the two peripheral rows 26 has a second firmness value greater than the first firmness value of the inner pocket springs 20.

In other words, inner pocket springs 20 may be constructed of about 15-gauge wire; while, outer pocket springs 24 and 28 may be constructed of about 13.5-gauge wire.

The out of pocket height of the springs from pocket springs 20, 24 and 28 is substantially equal. Similarly, the in-pocket height of each pocket spring 20, 24 and 28 is substantially equal.

Figure 3:
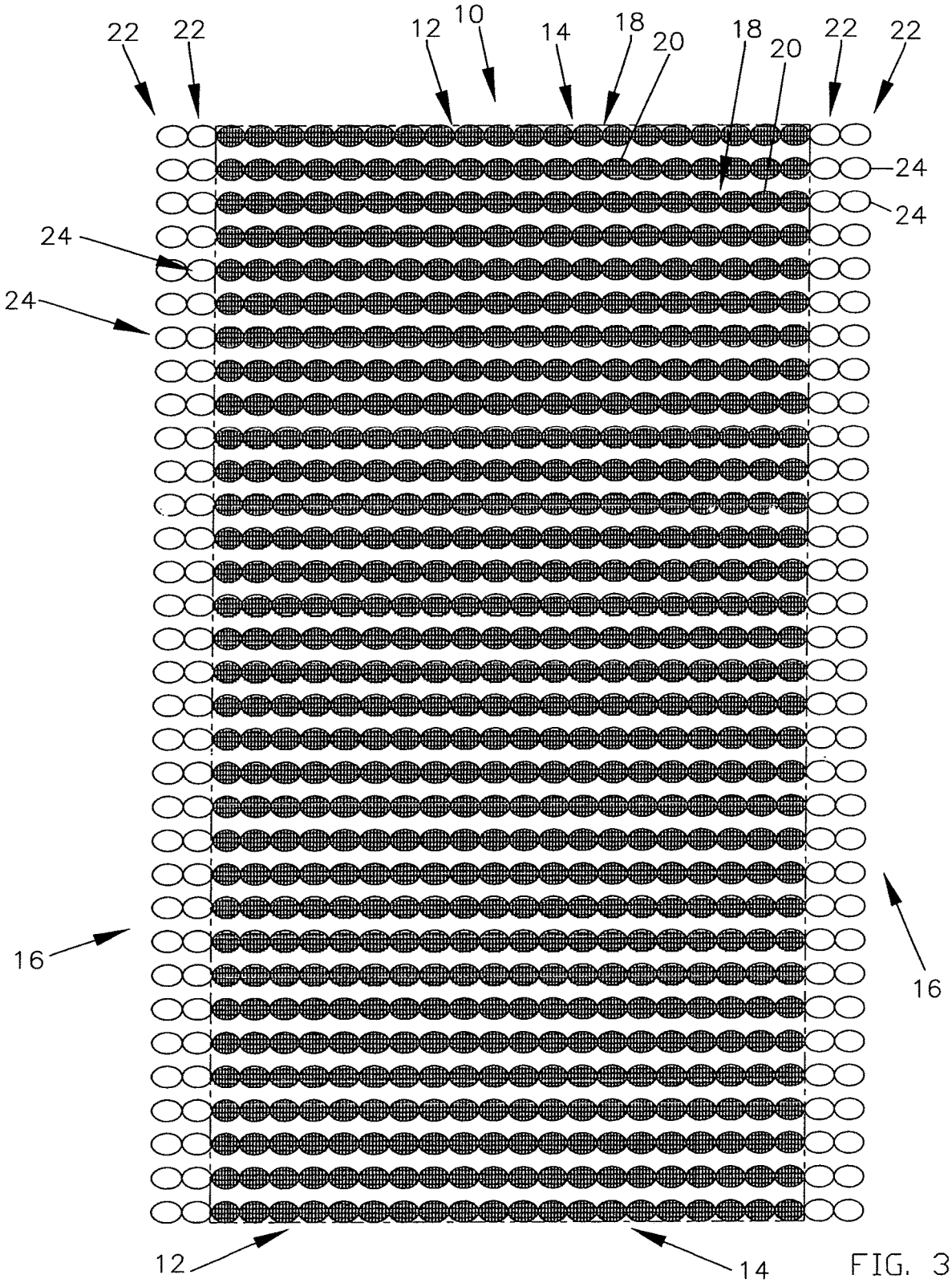
FIG. 3 is a top diagrammatic view of an alternate embodiment of the mattress foundation of the present invention shown in FIG. 2.

FIG. 3 is an alternate embodiment of the mattress foundation 10 shown in FIG. 2 without the two peripheral rows 26 of outer pocket springs 28.

Specifically, the mattress foundation 10 including end portions 14 and side portions 16 comprises an interior core of pocket springs 12.

The interior core 12 of pocket springs comprises a plurality of substantially parallel interior columns 18 of inner pocket springs 20 extending between end portions 14 of the mattress foundation 10.

A plurality of substantially parallel peripheral columns each generally indicated as 22 of outer pocket springs 24 extend along the sides 16 of the mattress foundation 10 and substantially parallel to interior columns 18 of inner pocket springs 20.

The configuration or pattern of the pocket springs 20 and 24 comprises springs of different firmness to create a peripheral border of greater support on the sides 16 of the mattress foundation 10.

For example, each inner pocket spring 20 of the interior core 12 has a first firmness value. Each outer pocket spring 24 of the two peripheral columns 22 has a second firmness value greater than the first firmness value of the inner pocket springs 20.

In other words, inner pocket springs 20 may be constructed of about 15-gauge wire; while outer pocket springs 24 may be constructed of about 13.5-gauge wire.

The out of pocket height of the springs from pocket springs 20 and 24 is substantially equal. Similarly, the in-pocket height of each pocket spring 20 and 24 is substantially the same.

Figure 4:
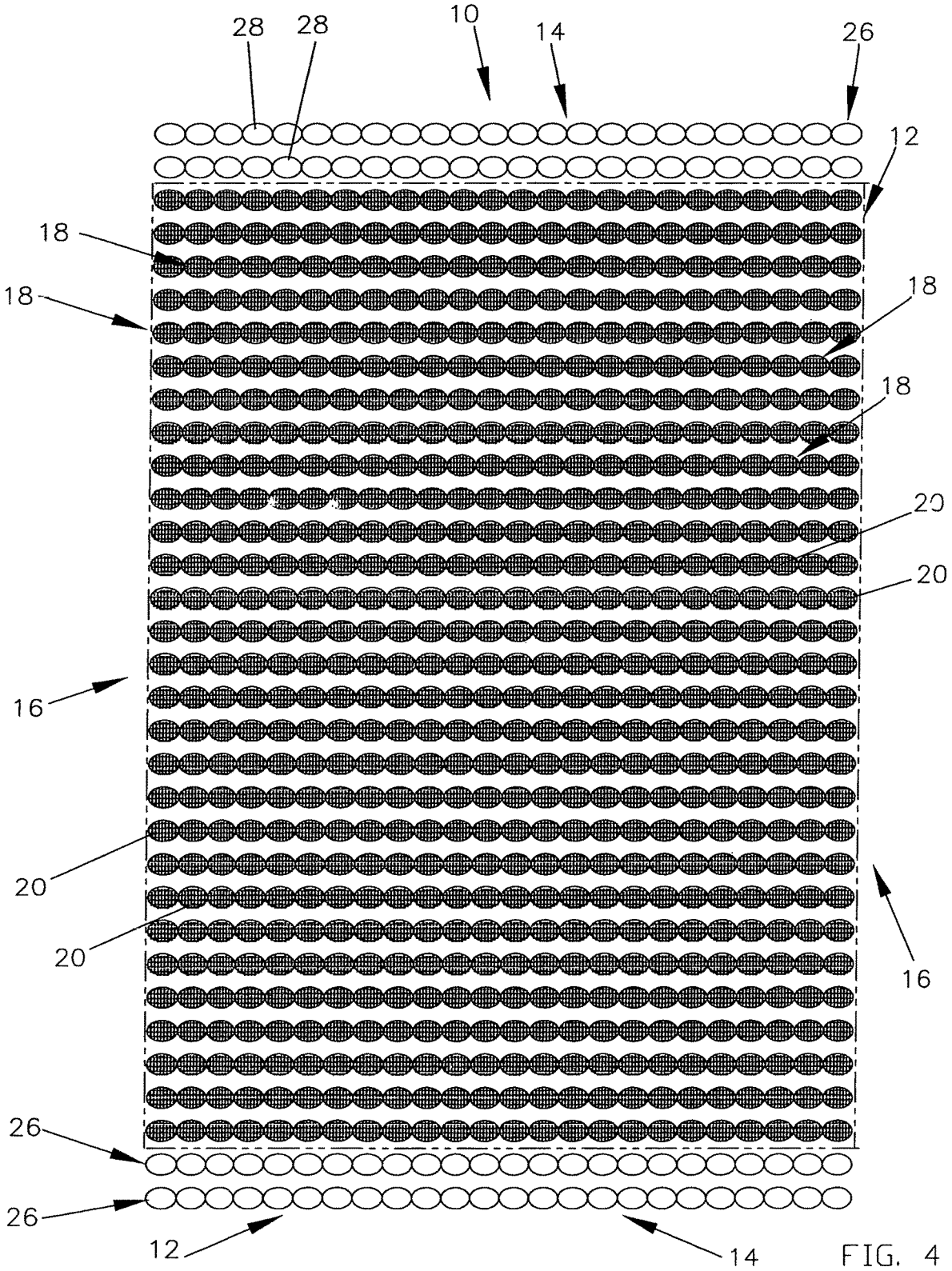
FIG. 4 is a top diagrammatic view of another alternate embodiment of the mattress foundation of the present invention shown in FIG. 2.

FIG. 4 is another alternate embodiment of the mattress foundation 10 shown in FIG. 2 without the peripheral columns 22 of inner pocket springs 24.

In particular, the mattress foundation 10 comprises an interior core of pocket springs 12.

The interior core 12 of pocket springs including end portions 14 and side portions 16 comprises a plurality of substantially parallel interior columns 18 of inner pocket springs 20 extending between end portions 14 of the mattress foundation 10.

A plurality of substantially parallel peripheral rows 26 of outer pocket springs 28 extend along the ends 14 of the mattress foundation 10 and substantially perpendicular to the parallel peripheral columns 22 of outer pocket springs 24.

The configuration or pattern of the pocket springs. 20 and 28 comprises springs of different firmness to create a peripheral border of greater support on the ends 14 of the mattress foundation 10.

For example, each inner pocket spring 20 of the core 12 has a first firmness value. Each outer pocket spring 28 of the two peripheral rows 26 has a second firmness value greater than the first firmness value of the inner pocket springs 20.

In other words, pocket springs 20 and 28 may be constructed of about 15-gauge wire; while, pocket springs 28 may be constructed of about 13.5-gauge wire.

The out of pocket height of the pocket springs 20 is substantially equal. Similarly, the in-pocket height of the pocket springs 20 and 28 is substantially equal.

Figure 5:
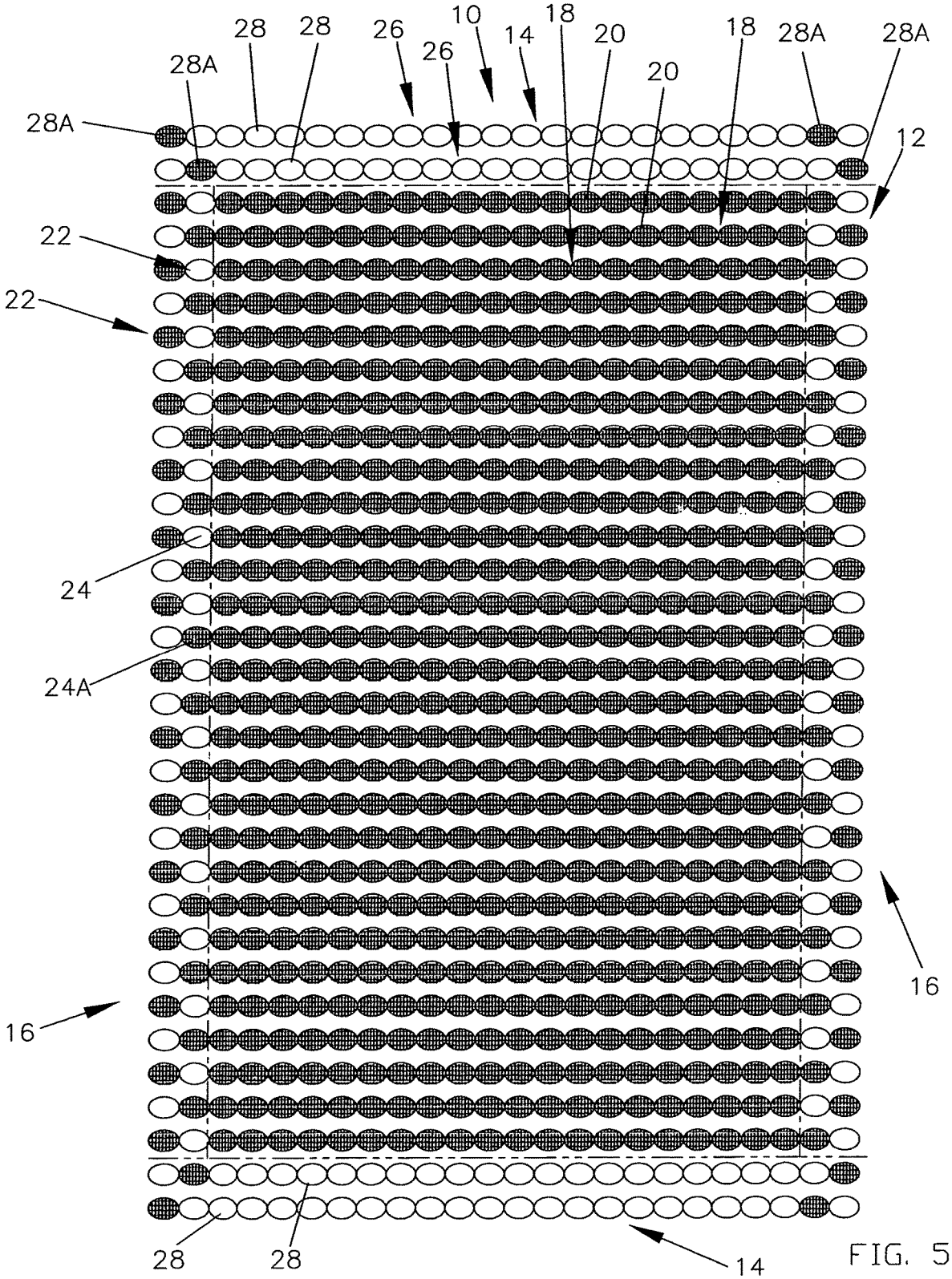
FIG. 5 is a top diagrammatic view of yet another alternate embodiment of the mattress foundation of the present invention shown in FIG. 2.

FIG. 5 is yet another alternate embodiment of the mattress foundation 10 shown in FIG. 2.

In particular, the mattress foundation 10 including end portions 14 and side portions 16 comprises an interior core of pocket springs 12.

The interior core 12 of pocket springs comprises a plurality of substantially parallel interior columns each generally indicated as 18 of inner pocket springs 20 extending between end portions 14 of the mattress foundation 10.

The exterior periphery of pocket springs comprises two substantially parallel peripheral columns 22 of outer pocket springs 24 extending between end portions 14 of the mattress foundation 10 and substantially parallel to the interior columns 18 of inner pocket springs 20 and two substantially parallel peripheral rows 26 of outer pocket springs 28 extending between side portions 16 of the mattress foundation 10 and substantially perpendicular to the substantially parallel interior columns 18 of inner pocket springs 20 and substantially perpendicular to the parallel peripheral columns 22 of outer pocket springs 24.

Adjacent outer pocket springs 24 and 24A of the two peripheral columns 22 alternate in firmness values; while, the outer pocket springs 28 includes the two peripheral rows 26 that have substantially the same firmness value. In addition, adjacent two pocket springs 28 and 28A at each end of each peripheral row 26 have different firmnesses.

The configuration or pattern of the pocket springs 20, 24, 24A, 28 and 28A comprises springs of different firmness to create a peripheral border of greater support on at least one end portion 14 or side portion 16 of the mattress foundation 10.

For example, each inner pocket spring 20 of the interior core 12 and, each outer pocket spring 24A of each of the two substantially parallel columns 22 and each outer pocket spring 28A of the substantially parallel rows 20 has a first firmness value. Each outer pocket spring 24 of the two peripheral columns 22 and each outer pocket spring 28 of the two peripheral rows 26 has a second firmness value greater than the first firmness value of the pocket springs 20, 24A and 28A.

In other words, pocket springs 20, 24A and 28A may be constructed of about 15-gauge wire; while, pocket springs 24 and 28 may be constructed of about 13.5-gauge wire.

The out of pocket height of the springs from pocket springs 20, 24, 24A, 28 and 28A is substantially equal. Similarly, the in-pocket height of each pocket spring 20, 24, 24A, 28 and 28A is substantially equal.

Figure 6:
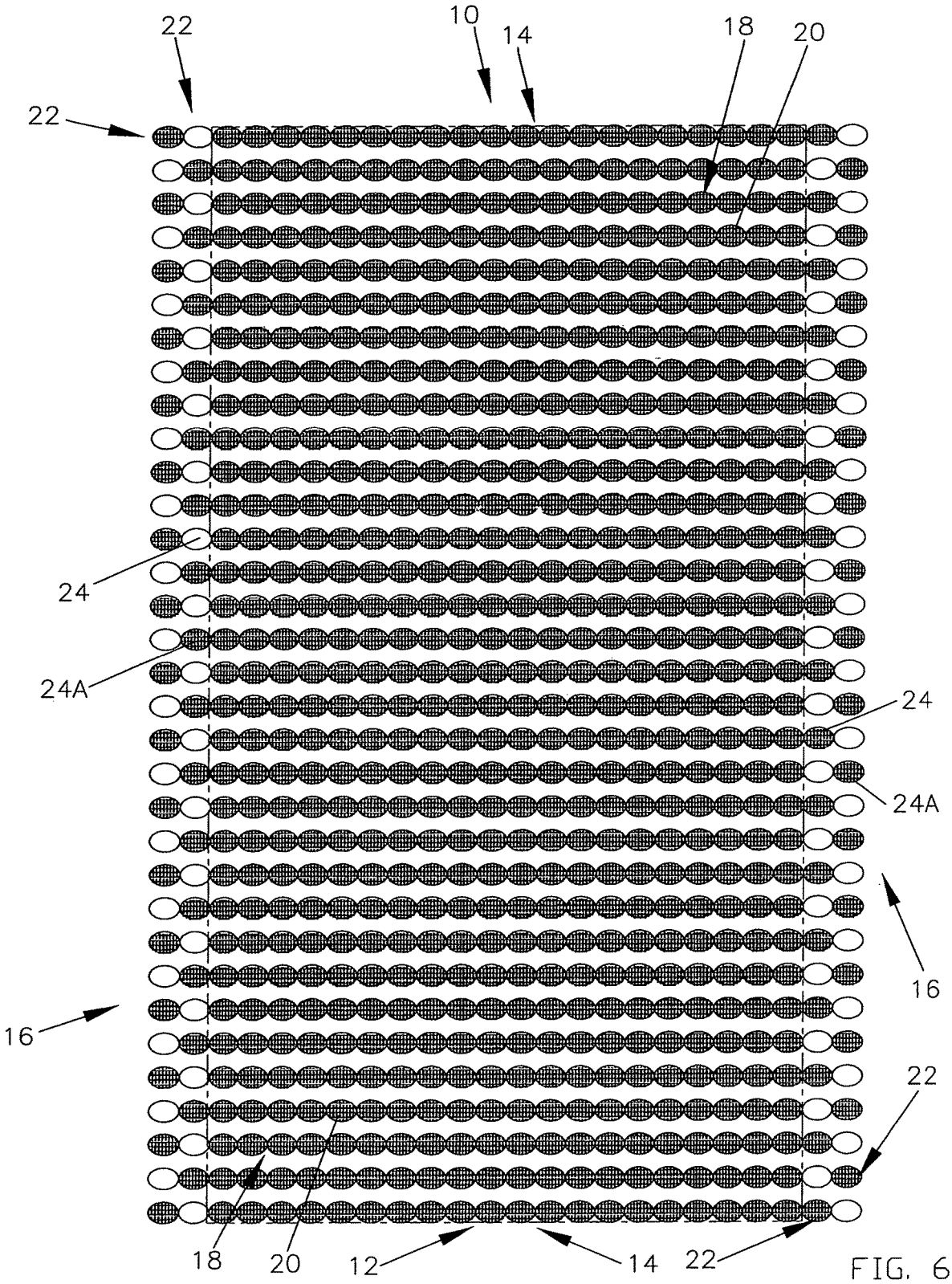
FIG. 6 is a top diagrammatic view of alternate embodiment of the mattress foundation of the present invention shown in FIG. 5.

FIG. 6 is an alternate embodiment of the mattress foundation 10 shown in FIG. 5 without the two peripheral rows 26 of inner pocket springs 28.

Specifically, the mattress foundation 10 comprises an interior core of pocket springs 12.

The interior core 12 of pocket springs including end portions 14 and side portions 16 comprises a plurality of substantially parallel interior columns 18 of inner pocket springs 20 extending between end portions 14 of the mattress foundation 10.

Two substantially parallel peripheral columns 22 of outer pocket springs 24 extend along the sides 16 of the mattress foundation 10 substantially parallel to interior columns 18 of inner pocket springs 20.

Adjacent outer pocket springs 24 and 24A of the two peripheral columns 22 alternate in firmness values.

The configuration or pattern of the pocket springs 20, 24 and 24A comprises springs of different firmness to create a peripheral border of greater support on the sides 16 of the mattress foundation 10.

For example, each inner pocket spring 20 of the interior core 12 and each outer pocket spring 24A of each of the two substantially parallel columns 22 has a first firmness value. Each outer pocket spring 24 of the two peripheral columns 22 has a second firmness value greater than the first firmness value of the inner pocket springs 20 and 24A.

In other words, pocket springs 20 and 24A may be constructed of about 15-gauge wire; while, pocket springs 24 may be constructed of about 13.5-gauge wire.

The out of pocket height of the springs from pocket springs 20, 24 and 24A is substantially equal. Similarly, the in-pocket height of each pocket spring 20, 24 and 24A is substantially the same.

Figure 7:
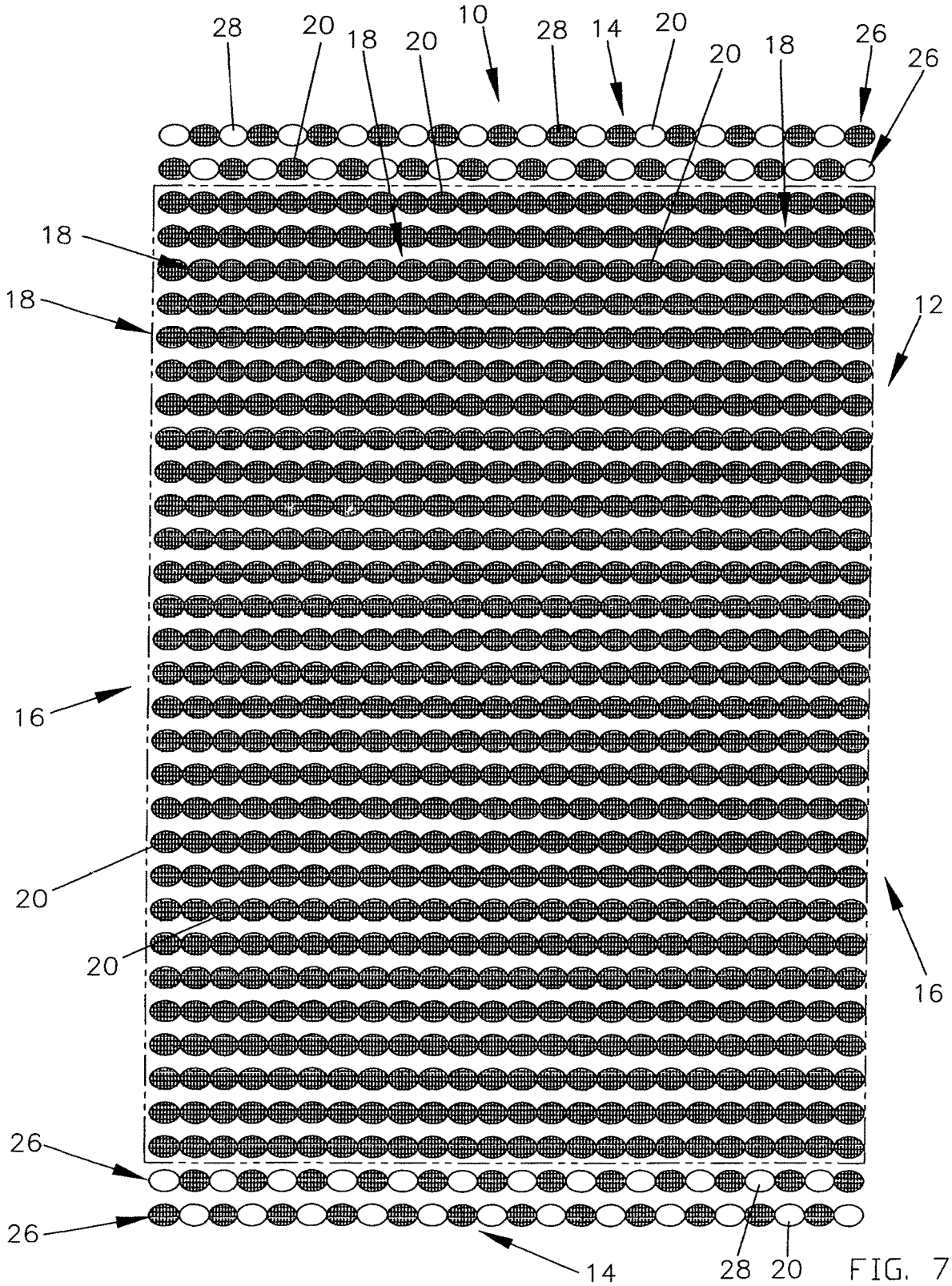
FIG. 7 is a top diagrammatic view of another alternate embodiment of the mattress foundation of the present invention shown in FIG. 5.

FIG. 7 is another alternate embodiment of the mattress foundation 10 shown in FIG. 5 without the peripheral columns 22 of inner pocket springs 24 and 24A.

In particular, the mattress foundation 10 including end portion 14 and side portion 16 comprises an interior core of pocket springs 12.

The interior core 12 of pocket springs comprises a plurality of substantially parallel columns 18 of inner pocket springs 20 extending between end portions 14 of the mattress foundation 10.

Two substantially parallel peripheral rows 26 of outer pocket springs 28 extend along the ends 14 of the mattress foundation 10 substantially perpendicular to substantially parallel columns 18 of inner pocket springs 20.

Adjacent outer pocket springs 28 and 28A of the two substantially parallel rows 26 of outer pocket springs 28 alternate in firmness values.

The configuration or pattern of the pocket springs 20, 28 and 28A comprises springs of different firmness to create a peripheral border of greater support on the ends 14 of the mattress foundation 10.

For example, each inner pocket spring 20 of the internal core 12 and each outer pocket spring 28A of the two peripheral rows 26 has a first firmness value. Each outer pocket spring 28 of the two peripheral rows 26 has a second firmness value greater than the first firmness value of the inner pocket springs 16 and outer pocket springs 28A.

In other words, pocket springs 20 and 28A may be constructed of about 15-gauge wire; while, pocket springs 28 may be constructed of about 13.5-gauge wire.

The out of pocket height of the pocket springs 20, 28 and 28A is substantially equal. Similarly, the in-pocket height of the pocket springs 20, 28 and 28A is substantially equal.

Although the springs 20, 24, 24A, 28 and 28A have been described as constructed for different gauge wire, other techniques or means may be used to create different firmness value while the in pocket and out of pocket heights remain equal.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible.

What is claimed:

1. A mattress foundation including end portions and side portions comprising an interior core of inner pocket springs disposed within an exterior periphery of pocket springs, said interior core of pocket springs comprises a plurality of substantially parallel interior columns of inner pocket springs extending between said end portions of the mattress foundation, an said exterior periphery of pocket springs comprises a plurality of substantially parallel peripheral columns of outer pocket springs extending between said end portions of the mattress foundation and a plurality of substantially parallel peripheral rows of outer pocket springs extending between said side portions of the mattress foundation and substantially perpendicular to said parallel peripheral columns of outer pocket springs, said plurality of substantially parallel peripheral columns of said outer pocket springs comprises at least two inner peripheral columns and an outer peripheral column and said plurality of substantially parallel peripheral rows of said outer pocket springs comprises at least two inner peripheral rows and an outer peripheral row, wherein each said inner pocket spring of said interior core has a first firmness value, each outer pocket spring of at least a pair of inner peripheral columns and each said outer pocket spring of at least a pair of inner peripheral rows has a second firmness value greater than said first firmness value of said inner pocket springs of said inner core and each said outer pocket spring of said outer peripheral column and each said outer pocket spring of said outer peripheral row has a firmness value less than the firmness value of said outer pocket springs in said at least a pair of inner most peripheral column and said outer pocket springs of said at least a pair of inner most peripheral row and wherein the out of pocket height of said interior core of pocket springs and said peripheral pocket springs are substantially equal and the in-pocket height of said interior core pocket springs and said peripheral pocket springs are substantially equal.

2. The mattress foundation of claim 1 wherein said at least two inner peripheral columns comprise about 13.5 gauge wire and said inner pocket springs comprise about 15 gauge wire.

3. A mattress foundation including end portions and side portions comprising an interior core of inner pocket springs disposed within an exterior periphery of pocket springs, said interior core of pocket springs comprises a plurality of substantially parallel interior columns of inner pocket springs extending between said end portions of the mattress foundation, said exterior periphery of pocket springs comprises a plurality of substantially parallel peripheral columns of outer pocket springs extending between each said end portions of the mattress foundation and a plurality of substantially parallel peripheral rows of outer pocket springs extending between each said side portion of the mattress foundation and substantially perpendicular to said parallel peripheral columns of outer pocket springs, said plurality of substantially parallel peripheral columns of said outer pocket springs comprises at least two inner peripheral columns and an outer peripheral column and said plurality of substantially parallel peripheral rows of said outer pocket springs comprises at least two inner peripheral rows and an outer peripheral row wherein each said inner pocket spring of said interior core has a first uniform firmness value, each outer pocket spring of at least two inner peripheral columns and each said outer pocket spring of at least two inner peripheral rows has a second uniform firmness value greater than said first uniform firmness value of said inner pocket springs of said inner core and each said outer pocket spring of said outer peripheral column and each said outer pocket spring of said outer peripheral row has a uniform firmness value less than the uniform firmness value of said outer pocket springs in said at least two inner most peripheral column and said outer pocket springs of said at least two inner most peripheral row.

4. The mattress foundation of claim 3 wherein the said at least two inner peripheral columns comprise about 13.5 gauge wire and said inner pocket springs comprise about 15 gauge wire.

* * * * *